US006360789B2

(12) United States Patent
Walker et al.

(10) Patent No.: US 6,360,789 B2
(45) Date of Patent: Mar. 26, 2002

(54) VAPOR RECOVERY LINE DIAGNOSTICS

(75) Inventors: Glenn Kline Walker, Springfield, OH (US); Rodger P. Grantham, Springfield, MO (US)

(73) Assignee: Vapor Systems Technologies, Inc., Dayton, OH (US)

( * ) Notice: Subject to any disclaimer, the term of this patent is extended or adjusted under 35 U.S.C. 154(b) by 0 days.

(21) Appl. No.: 09/796,108

(22) Filed: Feb. 28, 2001

Related U.S. Application Data

(60) Provisional application No. 60/185,721, filed on Feb. 29, 2000.

(51) Int. Cl.[7] ..... B65B 1/30; B65B 31/00; B67C 3/02

(52) U.S. Cl. ..... 141/95; 141/59; 141/302; 222/14

(58) Field of Search ..... 141/59, 95, 98, 141/198, 206–210, 217, 218, 225–228, 301, 302, 392; 222/3, 14

(56) References Cited

U.S. PATENT DOCUMENTS 5,184,309 A * 2/1993 Simpson et al. ..... 364/510
5,199,471 A 4/1993 Hartman et al.
5,636,667 A 6/1997 Young et al.
5,985,002 A 11/1999 Grantham

* cited by examiner

*Primary Examiner*—Timothy L. Maust
(74) *Attorney, Agent, or Firm*—Kilworth, Gottman, Hagan & Schaeff LLP

(57) ABSTRACT

A vapor recovery line monitor, a fuel dispenser, and fuel dispensing system are provided. In accordance with one embodiment of the present invention, a vapor recovery line monitor is provided comprising a fuel dispensing and vapor recovery hose, a pressure sensing passage, and a pressure transducer. The fuel dispensing and vapor recovery hose defines a fuel dispensing passage and a vapor recovery passage. The pressure sensing passage defines a pressure sensing orifice. The pressure sensing orifice is positioned within the vapor recovery passage. The pressure transducer is coupled to the pressure sensing passage and is configured to provide an indication of pressure at the pressure sensing orifice. Pressure data may be processed and compared to predetermined thresholds to trigger a vapor return line blockage signal. A controller may also be configured to shut down all or part of the system when a blockage signal is generated. Signals from the pressure transducer or the controller to which it is coupled may be transmitted to a central location by means of a wireless link.

29 Claims, 2 Drawing Sheets

VAPOR RECOVERY LINE DIAGNOSTICS

CROSS-REFERENCE TO RELATED APPLICATIONS

This application claims the benefit of U.S. Provisional Application Ser. No. 60/185,721, filed Feb. 29, 2000.

BACKGROUND OF THE INVENTION

The present invention relates to fuel dispensers, fueling systems and, more particularly, to a scheme for monitoring vapor recovery lines in a fueling system.

In response to ever increasing governmental pressures and regulations, the petroleum industry has increasingly made provision for recovering fuel vapors that are displaced from a fuel tank as fuel is discharged therein. Generally, there are two types of systems designed for vapor recovery—pressure balance recovery systems and vacuum assist vapor recovery systems.

Pressure balance systems involve the addition of a vapor return conduit system that extends from a dispenser nozzle, through a hose, to the dispenser pedestal and then through an underground conduit system to a point of disposal. Most frequently, the means of disposal was simply to return the vapors to the storage tank from which fuel was drawn to fill the fuel tank of the vehicle. As fuel is withdrawn in fueling a vehicle, the vapor space in the storage tank is increased. Conversely, as fuel is introduced into the fuel tank of a vehicle, vapor space is decreased to essentially an identical extent. The pressure differentials thus created cause the vapors to flow through the vapor conduit system from the nozzle back into the storage tank, thereby creating a pressure balance.

Most nozzles for pressure balance vapor recovery systems comprise a bellows or boot that surrounds the nozzle's spout. In delivering fuel, the spout is inserted into the inlet pipe of a vehicle fuel tank and the bellows is compressed to form a vapor seal with the inlet pipe. The bellows forms, in combination with the spout, an annular passage, which is the initial portion of the vapor return, conduit system. Vapors then flow through internal passages in the nozzle body to the hose end thereof. In most instances, the hose is of the coaxial type, with a central fuel passage and a surrounding coaxial vapor return passage, being formed by flexible tubes. The coaxial hose is connected by a fitting to the side of the dispenser pedestal. Vapor recovery lines within the pedestal connect with further vapor return lines, usually extending underground, that return the vapors to the storage tank.

Vacuum assist systems also employ vapor recovery lines but a vacuum assist is added to enhance the return of displaced vapors to the storage tanks. The vacuum assist also eliminates the need to rely upon a compression seal between a bellows and fuel tank inlet pipe. In most cases, the bellows is eliminated, since the vacuum of the vapor system is sufficient to draw substantially all of the displaced fuel vapors into inlet openings in the distal end of an essentially rigid spout, or in the spout end of the nozzle body. Vacuum assist nozzles also include a vapor return passage, usually formed interiorly of the nozzle body, for connection with a coaxial hose, at the opposite end of the nozzle.

Current vapor recovery systems do not provide an adequate means for monitoring vapor recovery or detecting possible obstructions or blockage of vapor recovery passages. Vapor recovery passages could potentially be blocked by condensed vapor or particulate matter, leading to inefficient or ineffective vapor recovery. Accordingly, there is a need for a scheme that enables monitoring of vapor recovery processes in a fuel dispensing system.

BRIEF SUMMARY OF THE INVENTION

This need is met by the present invention wherein a vapor recovery line monitor is provided. In accordance with one embodiment of the present invention, a vapor recovery line monitor is provided comprising a fuel dispensing and vapor recovery hose, a pressure sensing passage, and a pressure transducer. The fuel dispensing and vapor recovery hose defines a fuel dispensing passage and a vapor recovery passage. The pressure sensing passage defines a pressure sensing orifice. The pressure sensing orifice is positioned within the vapor recovery passage. The pressure transducer is coupled to the pressure sensing passage and is configured to provide an indication of pressure at the pressure sensing orifice.

The fuel dispensing passage and the vapor recovery passage may be defined as coaxial passages within the hose. The vapor recovery passage may surround the fuel dispensing passage and the pressure sensing passage may be positioned within the vapor recovery passage.

The hose may extend from a fuel input end to a fuel dispensing end and the pressure sensing orifice may be positioned proximately to the fuel dispensing end of the hose. The hose extends from a fuel input end to a fuel dispensing end and includes a fuel dispensing nozzle at the fuel dispensing end. The pressure sensing orifice may be positioned within the fuel dispensing nozzle. The hose may also include a coupling arranged to define respective portions of the fuel dispensing passage, the vapor recovery passage, and the pressure sensing passage. The coupling may be a breakaway coupling.

The pressure transducer may comprise a dual input transducer having a first input coupled to the pressure sensing passage and a second input coupled to atmospheric pressure.

In accordance with another embodiment of the present invention, a fuel dispenser is provided comprising a fuel dispensing and vapor recovery hose, a meter, a fueling pedestal, and a vapor recovery line. The fuel dispensing and vapor recovery hose defines a fuel dispensing passage and a vapor recovery passage. The meter is configured to provide an indication of an amount of fuel dispensed through the hose. The fueling pedestal is configured to support the hose and the meter. The vapor recovery line monitor comprises a pressure sensing passage and a pressure sensing transducer. The pressure sensing passage defines a pressure sensing orifice positioned within the vapor recovery passage of the hose. The pressure transducer is coupled to the pressure sensing passage and is configured to provide an indication of pressure at the pressure sensing orifice.

In accordance with yet another embodiment of the present invention, a fuel dispensing system is provided comprising at least one fuel storage tank, at least one fuel dispenser, at least one fuel dispensing line configured to couple the fuel storage tank to the fuel dispenser, and at least one vapor recovery line configured to couple the fuel storage tank to the fuel dispenser. The fuel dispenser comprises a fuel dispensing and vapor recovery hose, a meter, a pedestal coupling, and a vapor recovery line monitor. The vapor recovery line monitor comprises a pressure sensing passage and a pressure transducer. The pressure sensing passage defines a pressure sensing orifice positioned within the vapor recovery passage of the hose. The pressure transducer is coupled to the pressure sensing passage and is configured to provide an indication of pressure at the pressure sensing orifice.

A plurality of pressure transducers may be configured to provide an indication of pressure at the pressure sensing orifice, within the vapor recovery line, the fuel storage tank, and the fuel dispenser. The pressure transducer may be coupled to a dispenser display and may be configured to provide an indication of pressure.

The fuel dispensing system may include a vacuum assist pump in communication with the vapor recovery passage and may further comprise an additional pressure transducer configured to provide an indication of operational characteristics of the vacuum assist pump.

The pressure transducer may be coupled to a controller and the controller may be configured to process pressure measurements received from the transducer. The controller may be configured to store pressure data taken over a predetermined time period and display the stored data. A plurality of a pressure sensing passages may be configured to define a plurality of diagnostic points within the vapor recovery passage. The controller may be configured to store pressure data taken at the plurality of diagnostic points and utilize the stored data in system diagnostics.

Accordingly, it is an object of the present invention to provide a scheme for monitoring vapor recovery processes in a fuel dispensing system. Other objects of the present invention will be apparent in light of the description of the invention embodied herein.

BRIEF DESCRIPTION OF THE SEVERAL VIEWS OF THE DRAWINGS

The following detailed description of the preferred embodiments of the present invention can be best understood when read in conjunction with the following drawings, where like structure is indicated with like reference numerals and in which.

DETAILED DESCRIPTION

Figure 1:
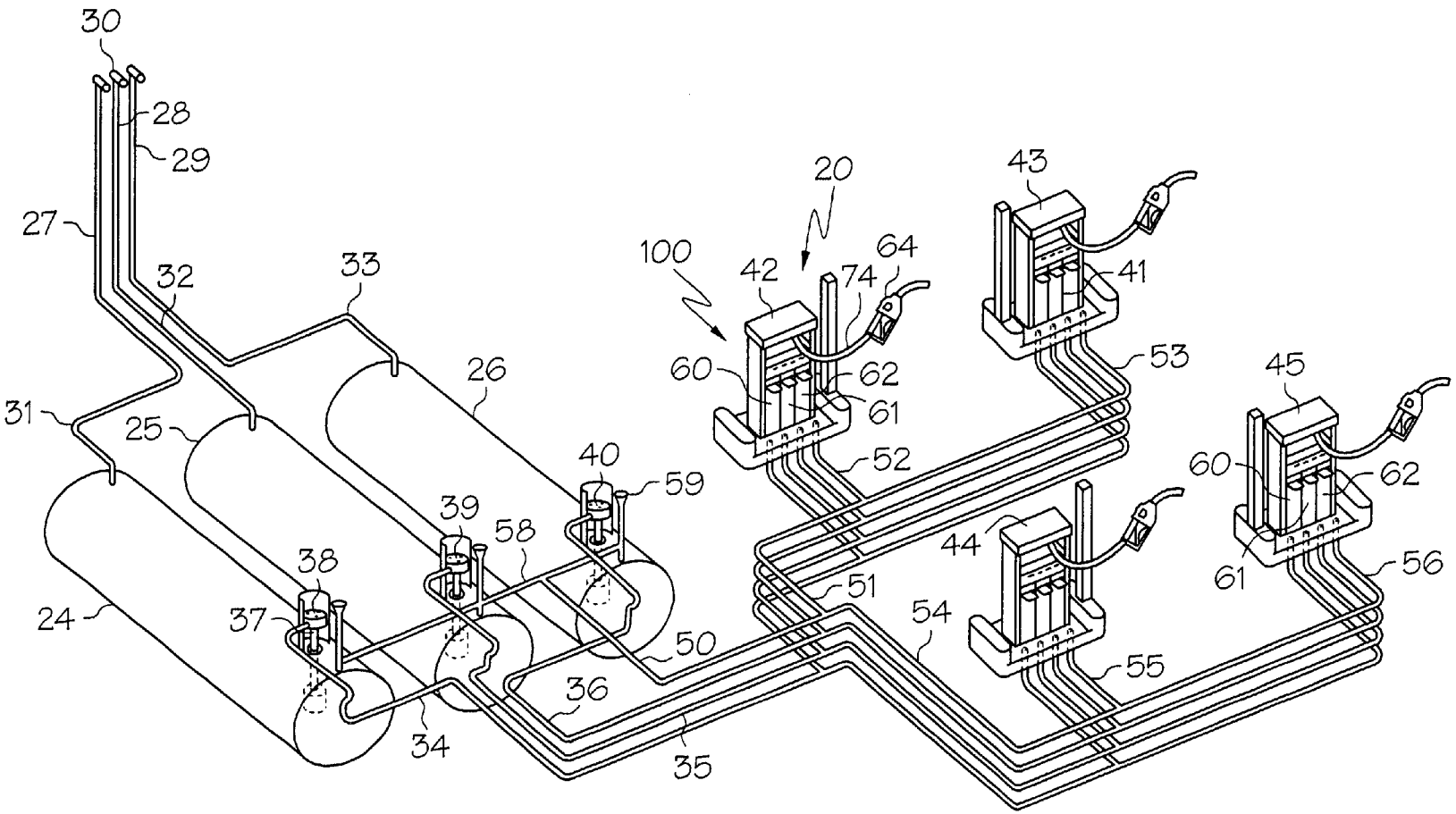
FIG. 1 is an illustration of a fuel dispensing system according to the present invention.

Referring initially to FIG. 1, a fuel dispensing system 20 according to the present invention is illustrated. The fuel dispensing system 20 typically includes a plurality of underground fuel storage tanks 24–26, each of which contain gasoline vapors and a particular grade of gasoline. For example, where three underground storage tanks 24–26 are provided, each tank will contain either regular, premium, or an intermediate grade gasoline.

A series of upright vertical vent pipes 27–29 are connected through horizontal vent lines 31–33 to the underground storage tanks 24–26 to vent and atmospherically balance the underground storage tanks 24–26. The vent pipes 27–29 can be equipped with vacuum vent caps 30, such as at one-half ounce vacuum pressure. The vent caps 30 are provided with pressure relief valves which open when the pressure in the underground storage tanks 24–26 rises too high. The vent pipes 27–29 may also be equipped with a vent filter assembly, such as the filter assembly taught in U.S. Pat. No. 5,985,002, the disclosure of which is incorporated herein by reference.

Fuel flow pipe lines or fuel dispensing lines 34–36 extend between, are connected to, and communicate with the underground storage tanks 24–26 and a plurality of fuel dispensers or upright dispensing units 42–45 to convey gasoline from the underground storage tanks 24–26 to the dispensing units 42–45. A plurality of fuel pumps 37 pump the gasoline from the storage tanks 24–26 to the dispensing units 42–45 via fuel lines 34–36. The fuel pumps 37 can include storage tank pump assemblies 38–40, such as submerged pumps which are at least partially positioned and submerged in the underground storage tanks 24–26. Suction fuel pumps 41, located in the bottom portion of the dispensing units 42–45, can be used in lieu of the storage tank pumps 38–40, if desired. Vapor return or recovery lines 50–56 extend between, connect, and communicate with the dispensing units 42–45 and a manifold 58 comprising a common manifold line extending between and communicating with each of the underground storage tanks 24–26.

The manifold 58 can also be equipped with extractable check valve assemblies 59 which serve to prevent product flow between tanks through the manifold 58. The vapor recovery lines 50–56 pass gasoline vapors from the dispensing units 42–45 to the underground storage tanks 24–26. Each of the fuel dispensers 42–45 includes a fuel dispensing and vapor recovery hose 74 and may include individual sub-dispensing units 60–62 for each grade of gasoline. Each hose 74 includes a fuel dispensing nozzle 64.

Figure 2:
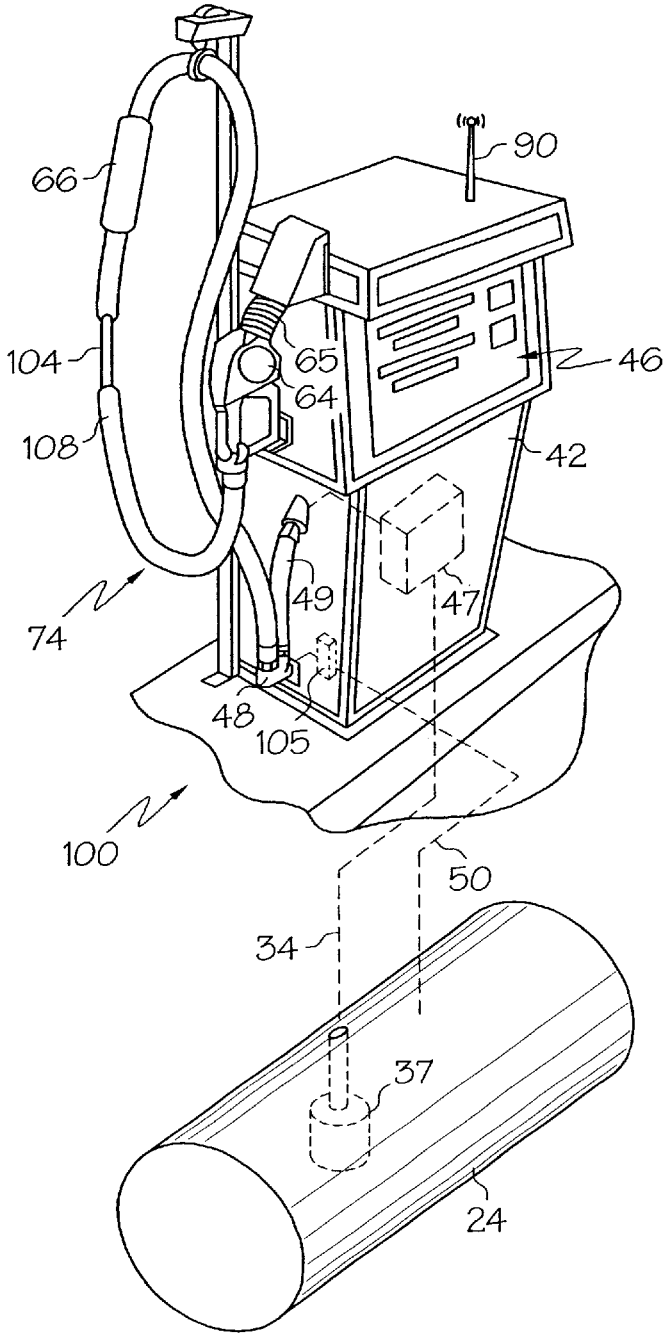
FIG. 2 is an illustration of a fuel dispenser according to the present invention.

FIG. 2 illustrates a pedestal-type fuel dispenser 42 mounted on an elevated island at a filling station. Fuel to be dispensed from the dispenser 42 is derived from an underground storage tank 24, being conveyed thereto by an underground fuel dispensing line 34, in the manner described above. Typically, as fuel is dispensed, it drives a meter 47 mounted within the dispenser 42 and its output is shown on a register 46 that indicates the amount and cost of fuel delivered. Fuel flows from the meter 47 through a jumper hose 49 to a dispenser coupling 48.

The dispenser coupling 48 has provision for connection to the hose 74, having both fuel and vapor passages. Specifically, the coaxial hose 74 comprises an inner tube 104 defining a fuel dispensing passage 106 and an outer tube 108 defining a vapor recovery passage 110. The opposite end of the coaxial hose 74 includes the fuel dispensing nozzle 64. The nozzle 64 is typically provided with a bellows 65 which is utilized in providing a sealed connection with the inlet pipe of a vehicle fuel tank during the delivery of fuel from the nozzle 64. The sealed connection provides a vapor connection between the fuel tank and a vapor recovery flow path. The vapor recovery flow path extends through the nozzle 64, through the vapor recovery passage 110 of the coaxial hose 74, through the dispenser coupling 50, and then through the vapor recovery line 50 to the storage tank 24. A breakaway coupling 66 is provided intermediate the length of the hose 74 to minimize damage in the event a vehicle is driven away with the nozzle lodged in its fuel tank. Preferably each coupling is arranged to define respective portions of the fuel dispensing passage, the vapor recovery passage, and the pressure sensing passage.

Figure 3:
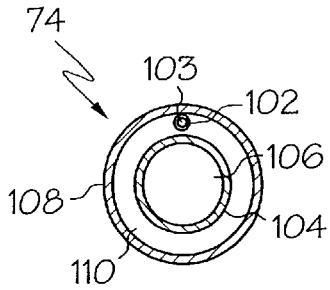
FIG. 3 is a cross-sectional illustration of a fuel dispensing and vapor recovery hose according to the present invention.

The pedestal-type fuel dispenser 42 is part of the fuel dispensing system 20 and is further provided with a vapor recovery line blockage monitor 100 associated with each of the fuel dispensers. The blockage monitor 100 is illustrated in detail in FIGS. 2 and 3 and comprises a pressure sensing passage or tube 102 within the hose 74 and a pressure sensing transducer 105. The pressure sensing passage 102 terminates at an orifice 103 within the vapor recovery passage 110 and the pressure sensing transducer 105 is coupled to the pressure sensing passage 102.

The pressure transducer 105 provides an indication of pressure within the vapor recovery passage 110 because its input is coupled to the pressure sensing passage 102 and the pressure sensing passage extends through the vapor recovery passage 110 terminating at the orifice 103 within the vapor recovery passage 110. The position of the orifice 103 within the vapor recovery passage 110 controls the point at which pressure is sensed. Preferably, the orifice 103 is positioned as close as possible to the terminus of the vapor recovery passage 110, in the nozzle 64.

As pressure within the vapor recovery passage 110 increases, the volume of vapor recovered through the vapor recovery passage decreases. Accordingly, an increase in pressure within the vapor recovery passage 110 will be indicative of a problem with vapor recovery operations of the fuel dispensing system 20. For example, a blockage or obstruction within the vapor recovery passage 110 will result in an increase in pressure at the nozzle-end or terminus of the vapor recovery passage 110. This increase in pressure may be sensed by the pressure transducer 105 and converted to a visual display or other warning indication. The warning indication may be displayed at the dispenser or at another location. The pressure transducer 105 may be secured to the outside of the hose 74, to one of the hose couplings, to the nozzle 64, to the dispenser 42, or within the dispenser 42.

The pressure sensed by the transducer 105 may also be monitored for diagnostic purposes. In one embodiment of the present invention, a plurality of diagnostic points within the vapor recovery passage 110 are established by arranging a plurality of distinct pressure sensing passages 102, each defining distinct pressure sensing orifices 103 at different points along the vapor recovery passage 110. The pressure transducer 105 may be configured to receive and process a plurality of pressure inputs. Alternatively, separate transducers 105 may be provided for each pressure sensing passage. In some instances, system accuracy may be enhanced by providing a pressure transducer including an input port coupled to atmospheric pressure.

The pressure transducer 105 may be coupled to a controller configured to process pressure measurements in a variety of ways. Specifically, pressure data may be processed and compared to predetermined thresholds to trigger a vapor return line blockage signal. The controller may also be configured to shut down all or part of the system when a blockage signal is generated.

Pressure data taken over predetermined time periods may be available for display or may be used to aid in the determination of whether a vapor recovery problem exists. Pressure data may also be used in system diagnostics, particularly where a plurality of diagnostic points within the vapor recovery passage 110 are established. The controller may be arranged at the fuel dispenser 42 or may be arranged in a central location in communication with a plurality of pressure transducers 105 associated with different dispensers 42.

Signals from the pressure transducer 105 or the controller to which it is coupled may be transmitted to a central location by means of a wireless link, e.g, an RF transmitter 90. In this manner, existing fueling stations may be equipped with the vapor recovery line monitor of the present invention without encountering the costly, disruptive, and time consuming procedures associated with laying underground wires. Further, the wireless link concept enables a number of dispensers from a number of different fueling stations to be coupled to a single central controller, data processor, or communications hub.

The system controller and wireless link may also be used to process data and provide operational information. The operational information provided would be specific to each fueling point within the system and may be utilized in system management.

Having described the invention in detail and by reference to preferred embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A vapor recovery line monitor comprising:

a fuel dispensing and vapor recovery hose defining a fuel dispensing passage and a vapor recovery passage;

a pressure sensing passage defining a pressure sensing orifice, wherein said pressure sensing orifice is positioned within said vapor recovery passage; and a pressure transducer coupled to said pressure sensing passage, wherein said pressure transducer is configured to provide an indication of pressure at said pressure sensing orifice.

2. A vapor recovery line monitor as claimed in claim 1 wherein said fuel dispensing passage and said vapor recovery passage are defined as coaxial passages within said hose.

3. A vapor recovery line monitor as claimed in claim 2 wherein said vapor recovery passage surrounds said fuel dispensing passage and wherein said pressure sensing passage is positioned within said vapor recovery passage.

4. A vapor recovery line monitor as claimed in claim 1 wherein said pressure sensing passage is positioned within said vapor recovery passage.

5. A vapor recovery line monitor as claimed in claim 1 wherein said hose extends from a fuel input end to a fuel dispensing end and wherein said pressure sensing orifice is positioned proximate said fuel dispensing end of said hose.

6. A vapor recovery line monitor as claimed in claim 1 wherein:

said hose extends from a fuel input end to a fuel dispensing end;

said hose includes a fuel dispensing nozzle at said fuel dispensing end; and said pressure sensing orifice is positioned within said fuel dispensing nozzle.

7. A vapor recovery line monitor as claimed in claim 1 wherein said hose includes a coupling and said coupling is arranged to define respective portions of said fuel dispensing passage, said vapor recovery passage, and said pressure sensing passage.

8. A vapor recovery line monitor as claimed in claim 7 wherein said coupling is a breakaway coupling.

9. A vapor recovery line monitor as claimed in claim 1 wherein said pressure transducer is mechanically coupled to said hose.

10. A vapor recovery line monitor as claimed in claim 1 wherein said hose includes a coupling and said pressure transducer is secured to said coupling.

11. A vapor recovery line monitor as claimed in claim 10 wherein said coupling is a breakaway coupling.

12. A vapor recovery line monitor as claimed in claim 1 wherein:

said pressure transducer comprises a dual input transducer;

a first input of said dual input transducer is coupled to said pressure sensing passage; and a second input of said dual input transducer is coupled to atmospheric pressure.

13. A vapor recovery line monitor as claimed in claim 1 further comprising a wireless transmitter in communication with said pressure transducer and arranged to transmit a signal indicative of said pressure at said pressure sensing orifice.

14. A fuel dispenser comprising:

a fuel dispensing and vapor recovery hose defining a fuel dispensing passage and a vapor recovery passage;

a meter configured to provide an indication of an amount of fuel dispensed through said hose;

a fueling pedestal configured to support said hose and said meter; and a vapor recovery line monitor comprising a pressure sensing passage defining a pressure sensing orifice, wherein said pressure sensing orifice is positioned within said vapor recovery passage of said hose, and a pressure transducer coupled to said pressure sensing passage, wherein said pressure transducer is configured to provide an indication of pressure at said pressure sensing orifice.

15. A fuel dispenser as claimed in claim 14 wherein said pressure transducer is secured to said pedestal.

16. A fuel dispenser as claimed in claim 14 wherein said pressure transducer is secured within said pedestal.

17. A fuel dispenser as claimed in claim 14 further comprising a vapor recovery line, a fuel dispensing line, and a pressure sensing line within said pedestal and a pedestal coupling configured to place said vapor recovery passage in communication with said vapor recovery line, said fuel dispensing passage in communication with said fuel dispensing line, and said pressure sensing passage in communication with said pressure sensing line.

18. A fuel dispenser as claimed in claim 14 further comprising a wireless transmitter in communication with said pressure transducer and arranged to transmit a signal indicative of said pressure at said pressure sensing orifice.

19. A fuel dispensing system comprising at least one fuel storage tank, at least one fuel dispenser, at least one fuel dispensing line configured to couple said fuel storage tank to said fuel dispenser, and at least one vapor recovery line configured to couple said fuel storage tank to said fuel dispenser, wherein said fuel dispenser comprises:

a fuel dispensing and vapor recovery hose defining a fuel dispensing passage and a vapor recovery passage;

a meter configured to provide an indication of an amount of fuel dispensed through said hose;

a fueling pedestal configured to support said hose and said meter;

a pedestal coupling configured to place said vapor recovery passage in communication with said vapor recovery line and said fuel dispensing passage in communication with said fuel dispensing line; and a vapor recovery line monitor comprising a pressure sensing passage defining a pressure sensing orifice, wherein said pressure sensing orifice is positioned within said vapor recovery passage of said hose, and a pressure transducer coupled to said pressure sensing passage, wherein said pressure transducer is configured to provide an indication of pressure at said pressure sensing orifice.

20. A fuel dispensing system as claimed in claim 19 further comprising a plurality of pressure transducers configured to provide an indication of pressure at said pressure sensing orifice, within one or more of said vapor recovery line, said fuel storage tank, and said fuel dispenser.

21. A fuel dispensing system as claimed in claim 19 wherein said pressure transducer is further configured to provide an indication of pressure within one or more of said vapor recovery line, said fuel storage tank, and said fuel dispenser.

22. A fuel dispensing system as claimed in claim 19 wherein said pressure transducer is coupled to a dispenser display configured to provide an indication of pressure.

23. A fuel dispensing system as claimed in claim 19 wherein said fuel dispensing system includes a vacuum assist pump in communication with said vapor recovery passage.

24. A fuel dispensing system as claimed in claim 23 further comprising an additional pressure transducer configured to provide an indication of operational characteristics of said vacuum assist pump.

25. A fuel dispensing system as claimed in claim 19 wherein said pressure transducer is coupled to a controller and wherein said controller is configured to process pressure measurements received from said transducer.

26. A fuel dispensing system as claimed in claim 25 wherein said controller is configured to store pressure data taken over a predetermined time period and display said stored data.

27. A fuel dispensing system as claimed in claim 25 wherein a plurality of a pressure sensing passages are configured to define a plurality of diagnostic points within said vapor recovery passage and wherein said controller is configured to store pressure data taken at said plurality of diagnostic points and utilize said stored data in system diagnostics.

28. A fuel dispensing system as claimed in claim 25 wherein said controller is configured to process pressure data and trigger a vapor return line blockage signal.

29. A fuel dispensing system as claimed in claim 19 further comprising a wireless transmitter in communication with said pressure transducer and arranged to transmit a signal indicative of said pressure at said pressure sensing orifice.

* * * * *